United States Patent [19]

Bohrn

[11] 4,016,316

[45] Apr. 5, 1977

[54] YARN-UNRAVELING RESISTANCE IN CARPET

[75] Inventor: Walter J. Bohrn, Lancaster, Pa.

[73] Assignee: Armstrong Cork Company, Lancaster, Pa.

[22] Filed: Mar. 16, 1976

[21] Appl. No.: 667,369

[52] U.S. Cl. ..... 428/85; 156/72

[51] Int. Cl.[2] ..... B32B 5/00

[58] Field of Search ..... 156/72; 428/85, 92

[56] References Cited

UNITED STATES PATENTS

| | | | |
|---|---|---|---|
| 3,293,110 | 12/1966 | Stine, Jr. et al. | 428/362 |
| 3,654,063 | 4/1972 | Blackburn et al. | 428/310 |

*Primary Examiner*—William J. Van Balen

[57] ABSTRACT

The back side of a tufted carpet is treated with an agent which will substantially lower the breaking strength of the yarn at points on the backstitch of the yarn. The face yarns or tufts of the carpet are unaffected by the agent. The back of the carpet is covered by a conventional latex coating to bind the carpet yarns in position to the carpet backing. A force engaging an individual tuft and pulling it from the body of the carpet will pull out individual tufts rather than unravel a strand of yarn from the carpet backing.

5 Claims, 1 Drawing Figure

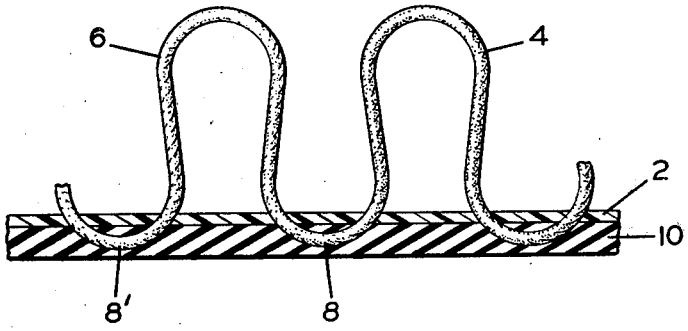
6
4
2
10
8'
8

YARN-UNRAVELING RESISTANCE IN CARPET

BACKGROUND OF THE INVENTION

1. Field of the Invention

The invention herein generally relates to carpeting and, more particularly, to a tufted carpet and a means to prevent unraveling of the yarn in the tufted carpet.

2. Description of the Prior Art

U.S. Pat. No. 2,999,297 is representative of the prior art and really teaches away from the invention herein. The patent teaches the increasing of the tensile strength of the scrim threads. The scrim threads are made from wet strength paper ribboned and twisted into a thread. The threads are waxed to facilitate entry of the tufting needles. There is no weakening of any portion of the carpet structure.

U.S. Pat. Nos. 3,166,465 and 3,779,799 show the use of reinforcing coatings on the carpet backing to reduce tuft unraveling.

Finally, U.S. Pat. No. 3,293,110 teaches that polymeric fibers have been developed which have weak spots placed throughout the length thereof.

The approach towards the solving of the unraveling problem to date has been one of increasing the tuft bind to very high levels, that is, in the order of 20 pounds, in order to minimize the chance of pulling out long strands of yarn. While systems have been developed to achieve the high tuft binds required, they inevitably have some serious drawbacks, such as high cost, increased flammability and/or smoke generation. The invention herein is concerned with a novel approach towards the solving of the unraveling problem. The concept involves the treating of the back side of the carpet with an agent which will substantially lower the breaking strength of the yarn at the point of the backstitch. The face yarns or tufts are substantially unmodified. Consequently, only individual tufts will be pulled out from the carpet and not a strand of yarn.

SUMMARY OF THE INVENTION

A carpet yarn is tufted into a carpet backing in a conventional manner to form a tufted carpet. The back side of the carpet, which contains the backstitch of the tufted yarn, is treated with a solvent which attacks the fibers of the yarn and weakens the yarn at the point of the backstitch. The solvent does not affect the carpet backing nor the face yarns (tufts) of the carpet. After this treatment, the back of the carpet backing is treated with a latex coating which tends to bind the tufted carpet yarns to the carpet backing.

During a tuft bind test, or in actual use, the grabbing of a single tuft of carpet and the pulling of it from the carpet backing will result in only the extraction of individual tufts from the carpet and not the pulling of a strand of carpet yarn from the carpet. The weakened fiber breaks at the backstitch and permits only an individual tuft to be pulled out. Were it not for the weakened condition of the yarn at the backstitch, a long strand of carpet yarn would be pulled out from the carpet, this long strand representing a plurality of tufts extending along the carpet structure.

BRIEF DESCRIPTION OF THE DRAWING

The one FIGURE of the drawing is a cross-sectional view of a tufted carpet.

DESCRIPTION OF THE PREFERRED EMBODIMENT

A conventional tufted carpet is formed by conventional tufting techniques utilizing a conventional tufting machine. The tufted carpet coming out of the tufting machine will have a backing 2 having tufted thereinto a yarn 4. The backing 2 may be any conventional carpet backing material, such as jute, woven or non-woven polypropylene, etc. The carpet yarn will be conventional yarn used for making carpeting and may be any type of conventional material, such as an acrylic or nylon. The portion of the carpet containing the large loops 6 is called the face of the carpet and the large loops 6 are called the tufts of the carpet. The small loops 8 are on the back side of the carpet and are called the backstitch of the carpet.

An appropriate solvent is placed on the back of the carpet on the backstitches 8 of the yarn. The carpet is fed face down underneath a conventional roll coater which applies the solvent solution to the back of the carpet. The solvent solution will then be dried either in steam or with dry heat. No washing of the carpet is carried out to remove the solvent from the carpet. After the solvent is dried, a conventional latex adhesive coating 10 is placed on the back of the carpet and there may even be provided a jute secondary backing on the back of the carpet.

The carpet is now provided with weakened fiber at the backstitch 8 so that if one would grab one of the loops 6 and pull it outward from the carpet structure, the loop would weaken at the backstitches 8 and 8' on the back side of the carpet and permit the individual tuft to be pulled out. Were it not for the weakened backstitches 8 and 8', the pulling on the tuft 6 would result in the pulling of the yarn 4 from the carpet backing through a large number of loops 6, leaving a disfigurement in the surface of the carpet and a rather long strand of yarn laying on the surface of the carpet. This pulling of the tufts from the carpet often occurs under actual wear conditions where a tuft is snagged by a highheeled shoe and, subsequently, a long strand of yarn is unraveled from the carpet. More often, and particularly in schools, the unraveling of the tufts is the direct result of vandalism.

Using a conventional tufted carpet as a standard and a carpet treated in accordance with the invention herein, the following tests were conducted. A conventional tuft bind test involves cutting the carpet tufts on either side of a loop of carpet which is to be plucked from the carpet. The loop of carpet to be plucked from the carpet is then connected to a conventional tester which will measure the force required to pull the loop free from the carpet. A modified tuft bind test is utilized wherein the loops on either side of the test loop are not cut and, therefore, pulling on the test loop results in an unraveling of the strand of yarn from the carpet and the force needed to carry out this unraveling is measured. The table below provides the number of pounds force needed when one utilizes the conventional tuft bind test and the modified tuft bind test when one is treating different carpet materials with different treatment cycles. An acrylic carpet was tested and the untreated carpet was compared with a treated carpet which had had the solvent dried by steam and another where the solvent had been dried only by heat. A nylon carpet was also tested and a comparison was made with an untreated nylon carpet versus a treated nylon carpet which had been dried only by heat. The comparative results are as follows:

| Test Conditions | Conventional Tuft Bind | Modified Tuft Bind |
|---|---|---|
| Acrylic Carpet | | |
| Untreated | 7.5 lbs. | 19 lbs. |
| Treated - steam dried | 2.2 lbs. | 5.4 lbs. |
| Treated - heat dried | 0 lbs. | 0 lbs. |
| Nylon Carpet | | |
| Untreated | 10.3 lbs. | 12.4 lbs. |
| Treated - heat dried | 0 lbs. | 2.5 lbs. |

The following will be given as two specific examples of carpet structures made utilizing the invention herein.

EXAMPLE 1

The carpet material is made in the conventional manner. It is made with an acrylic yarn and is tufted to a pile height of 9/32 of an inch with a gauge of 1/8 of an inch and a stitch rate of 9.0 SPI. The pile weight is 35 ounces per square yard of the carpet, and the yarn is 3 ply of a 3 cotton count.

This tufted carpet is then conveyed to a reverse roll coater which places a solvent on the back of the carpet. The solvent is of the following formulation:

| Ingredient | Percent by Weight |
|---|---|
| Zinc chloride | 10% |
| Cellosize QR100M - hydroxyethyl cellulose thickener | 0.38% |
| Water | 89.62% |

The solvent is thickened to approximately 1,000 cps and is uniformly applied to the back side of the carpet with a reverse roll coater. The application rate for the solvent is 38.5 ounces per square yard (wet basis). The carpet may then be dried by either one of two means. The carpet may be moved into a hot air impingement oven where it is dried for 12 minutes at 250° F. As an alternate drying technique, the carpet could be dried for 12 minutes in a steam chamber at 220° F. It would appear that the steaming process results in the steam somewhat diluting the action of the solvent on the fibers of the yarn on the backstitch of the carpet. After the drying of the solvent, no washing cycle is carried out to wash out or dilute or in any way affect the residual solvent on the back side of the carpet. There is then applied to the carpet a conventional latex adhesive coating, such as is normally used in the carpet art (see U.S. Pat. No. 3,922,454). The latex coating in part tends to bind the backstitch of the tufted yarn to the backside of the carpet backing and also serves as a binding means to permit a secondary jute backing to be fastened to the primary backing 2 of the carpet. The use of two backings primarily provides a reinforced and stabilized carpet structure.

EXAMPLE 2

The carpet material is made in the conventional manner. It is made with a nylon yarn and is tufted to a pile height of 5.32 of an inch with a gauge of 5/64 of an inch and a stitch of 6 SPI. The pile weight is 24 ounces per square yard of the carpet, and the yarn is 1125 denier, 3 ply.

The tufted carpet is then conveyed to a reverse roll coater which places a solvent on the back of the carpet. The solvent is of the following formulation:

| Ingredient | Percent by Weight |
|---|---|
| 70% Hydroxyacetic-acid | 39.3% |
| Citric acid | 27.5% |
| 77-80% Calcium chloride | 9.0% |
| Galaxy 790 - modified guar gum-xanthum gum thickener | 1.3% |
| Water | 22.9% |

The solvent is thickened to approximately 1,000 cps and is uniformly applied to the back side of the carpet with a reverse roll coater. The application rate for the solvent is 17.7 ounces per square yard (wet basis). The carpet may then be dried by either one of two means. The carpet may be moved into a hot air impingement over where it is dried for 12 minutes at 250° F. As an alternate drying technique, the carpet could be dried for 12 minutes in a steam chamber at 220° F. It would appear that the steaming process results in the steam somewhat diluting the action of the solvent on the fibers of the yarn on the backstitch of the carpet. After the drying of the solvent, no washing cycle is carried out to wash out or dilute or in any affect the residual solvent on the back side of the carpet. There is then applied to the carpet a conventional latex adhesive coating, such as is normally used in the carpet art. The latex coating in part tends to bind the backstitch of the tufted yarn to the backside of the carpet backing and also serves as a binding means to permit a secondary jute backing to be fastened to the primary backing 2 of the carpet. The use of two backings primarily provides a reinforced and stabilized carpet structure.

Naturally, carpets can be made of other materials than nylon and acrylic. Rayons, polyesters, and other similar synthetic materials have been utilized to make tufted carpets. Also, other solvents could be utilized other than those given herein. Resorcinol is an excellent solvent to use with nylon. An acid, such as acetic acid and a metal halide such as calcium chloride could also be used as a mixture with the nylon.

What is claimed is:

1. An article comprising a base structure of backing material having tufted thereinto a yarn, said yarn having large loops on one side of the backing material and smaller loops on the back side of the backing material, said small loops on the back side of the material being of yarn of relatively low breaking strength compared to the yarn in the large loops on the front side of the backing material, and a coating material applied over the back side of the backing material and over the smaller loops on the back side of the backing material.

2. The method of manufacturing a composite pile fabric structure which comprises backing material and a yarn tufted thereinto with large loops on one side of the backing material and small loops on the back side of the backing material, said method comprising the steps of:

a. tufting the yarn into the backing material;
b. applying a solvent to the yarn on the back side of the backing material to deteriorate and weaken the fibers in the yarn; and
c. applying a back coating to the back of the backing material and the yarn on the back of the backing material to bind the backing material and yarn together on the back side of the backing material.

3. The method of claim 2 wherein said solvent is coated on the back of the backing material and the coated material is then dried to remove the liquid portion of the solvent material from the back of the backing material.

4. The method of claim 3 wherein drying is carried out by a dry heat operation.

5. The method of claim 3 wherein the drying operation is carried out by a steam heating operation.

* * * * *